United States Patent [19]

Hudspeth et al.

[11] 4,119,931

[45] Oct. 10, 1978

[54] TRANSMISSION LINE SWITCH

[75] Inventors: Thomas Hudspeth, Malibu; Harmon H. Keeling, Los Angeles, both of Calif.

[73] Assignee: Hughes Aircraft Company, Culver City, Calif.

[21] Appl. No.: 702,795

[22] Filed: Jul. 6, 1976

[51] Int. Cl.[2] ..... H01P 1/10; H01P 5/18

[52] U.S. Cl. ..... 333/7 R; 333/10

[58] Field of Search ..... 333/7 R, 10

[56] References Cited

U.S. PATENT DOCUMENTS

| | | | |
|---|---|---|---|
| 2,486,818 | 11/1949 | Bowman | 333/10 |
| 2,735,069 | 2/1956 | Riblet | 333/10 X |
| 2,951,218 | 8/1960 | Arditi | 333/10 |
| 3,105,207 | 9/1963 | Capewell et al. | 333/10 |

FOREIGN PATENT DOCUMENTS

| | | | |
|---|---|---|---|
| 231,641 | 3/1969 | U.S.S.R. | 333/10 |

*Primary Examiner*—Paul L. Gensler

*Attorney, Agent, or Firm*—John Holtrichter, Jr.; W. H. MacAllister

[57] ABSTRACT

A TEM-mode transmission line switch coupling essentially all input power at a first port to a fourth port when in its uncoupled position and coupling a predetermined significant fraction of the input power to a second port with the remainder coupled to the fourth port when in its coupled position, the switch including a relatively wide spaced parallel transmission line section with a rotatable conductive vane disposed between the parallel lines to allow coupling of power between the lines in the coupled position and inhibit such coupling in the uncoupled position.

8 Claims, 4 Drawing Figures

TRANSMISSION LINE SWITCH

BACKGROUND OF THE INVENTION

The background of the invention will be set forth in two parts.

1. Field of the Invention

This invention relates to microwave devices and more particularly to transmission line switches.

2. Description of the Prior Art

As the communication satellite art has developed, it has become apparent that the ability to switch on a particular directional satellite-mounted antenna aimed at a desired location on earth while the spacecraft is in one orbit location and switch off this antenna while in another orbit location, would be highly desirable.

In the past, such switches utilized mechanically activated contacts. This type of switch is extensively utilized in present-day satellite applications, but a switch not using contact type switches would be definitely more reliable in a spacecraft environment.

The present invention moves away from the contact switch configuration and utilizes certain characteristics of TEM-Mode, coupled-transmission-line directional couplers in conjunction with a novel switching element introduced into the coupler. A very complete description of this type of directional couplers may be obtained from a reference such as a book entitled MICROWAVE FILTERS, IMPEDANCE-MATCHING NETWORKS, AND COUPLING STRUCTURES, by George L. Matthaei, Leo Young and E. M. T. Jones, McGraw-Hill Book Company, 1964, at Chapter 13.

SUMMARY OF THE INVENTION

In view of the foregoing factors and conditions characteristic of the prior art, it is a primary object of the present invention to provide a new and improved transmission line switch.

Another object of the present invention is to provide a simple yet reliable transmission line switch that has only one moving part.

Still another object of the present invention is to provide a square coaxial transmission line switch exhibiting relatively a very low voltage standing wave ratio (VSWR) in both its coupled and uncoupled configuration without changing the phase or path length in the direct through line.

Yet another object of the present invention is to provide a spacecraft-mounted TEM mode transmission line switch capable of switching energy into a directional antenna having an antenna lobe aimed at a desired region on earth when the craft is in one orbit location, and switching this lobe off at another orbit location.

Still a further object of the present invention is to provide a transmission line switch that is easily incorporated into an RF feed system, which switch weighs less than prior art switches used for a similar purpose and which has no electrical contacts and thus avoids intermittent problems often associated with the use of such contacts.

In accordance with one embodiment of the present invention a TEM mode transmission line switch is provided having a parallel transmission line coupler including first and second parallel lines, and coupling means including a conductive vane disposed between the parallel lines and rotatable on an axis parallel to the parallel lines for isolating the parallel lines in an uncoupled position and for electromagnetically coupling the parallel lines in a coupled position.

In the uncoupled position, essentially all input power at a first port connected to one end of the first parallel line is coupled to a fourth port at the other end of the line, and in the coupled position, a portion of the input power is coupled to a second port connected to an end of the second parallel line adjacent the first port, the remainder of the input power being coupled only to the fourth port.

The TEM mode coupler may be in a "square coax" configuration with the center conductors, as well as the conductive vane, having rectangular cross sections, the vane being supported on an insulated rod capable of being mechanically rotated at least about 90°.

The features of the present invention which are believed to be novel are set forth with particularity in the appended claims. The present invention, both as to its organization and manner of operation, together with further objects and advantages thereof, may best be understood by making reference to the following description, taken in conjunction with the accompanying drawing in which like reference characters refer to like elements in the several views.

DESCRIPTION OF THE PREFERRED EMBODIMENTS

Figure 1:
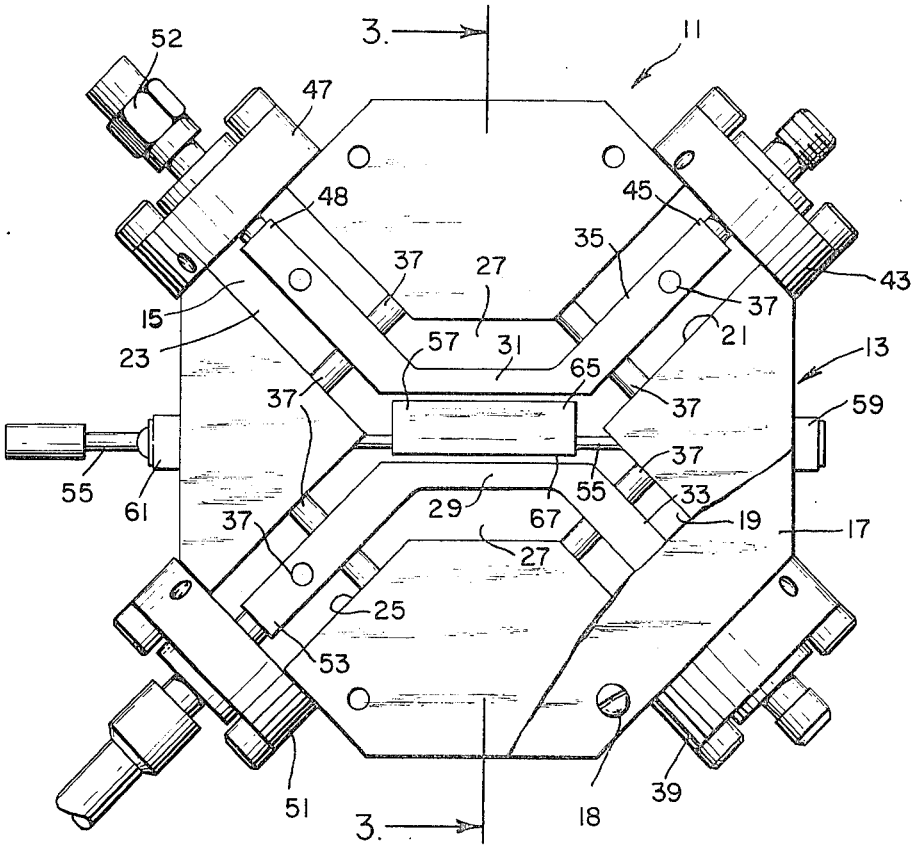
FIG. 1 is a plan view of a TEM-mode transmission line switch, with a portion of the cover plate removed, constructed in accordance with the present invention.

Referring now to the drawing and more particularly to FIG. 1, there is shown a transmission line switch 11 having a cast or machined conductive housing structure 13 preferably of a metal such as aluminum, for example. The housing 13 is provided with a bottom cover plate 15 and a top cover plate 17 (shown partially broken away in FIG. 1 and secured by machine screws 18), and also includes first through fourth port channels, 19, 21, 23, and 25, respectively. The four port channels join in a central portion 27 wherein is disposed approximately one-quarter wavelength parallel line portions 29 and 31 of respective first and second center conductors 33 and 35. The center conductors are supported symmetrically in the port channels and between the cover plates 15 and 17 by conventional post insulators 37.

Positioned at the outer extremities of the four port channels are conventional coaxial port connectors, namely, a first port connector 39 having its center conductor connected to a first end (not shown) of the first center conductor 33; a second port connector 43 having its center conductor connected to a first end 45 of the second center conductor 35; a third port connector 47 connected to a second end 48 of the second center conductor 35; and a fourth port connector 51 having its center conductor connected to a second end 53 of the first center conductor 33.

Figure 2:
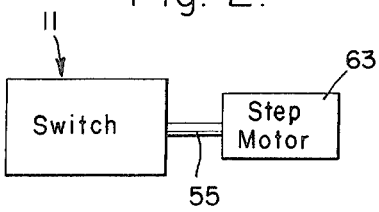
FIG. 2 is a block diagram showing the switch of FIG. 1 coupled to a drive motor.

Mounted on an elongated insulated rod 55, extending through appropriate bores in the structure 13, is a vane 57 of a conductive material such as silver plated aluminum, for example. The rod 55 is rotatably supported by two end bearings 59 and 61 and extends through the latter bearing for connection to any suitable drive mechanism 63 such as a conventional step motor and shown in FIG. 2. In this manner, the vane 57 may be oriented in, as desired, either the coupled position illustrated in the sectional view of FIG. 3, or in the uncoupled position shown in FIG. 4.

Figure 3:
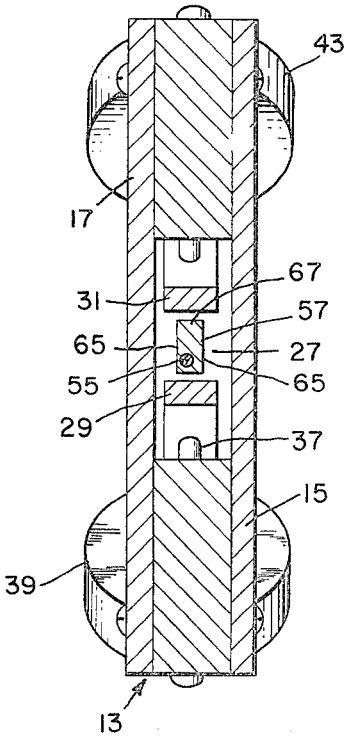
FIG. 3 is a sectional view of the transmission line switch of FIG. 1 taken along line 3—3 and showing the conductive vane in its coupled position.
Figure 4:
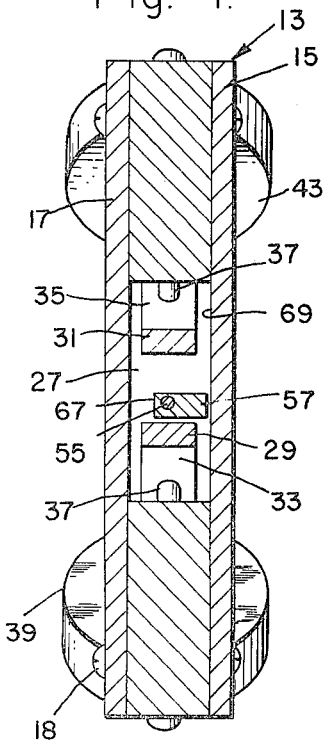
FIG. 4 is a sectional view similar to FIG. 3, but showing the conductive vane in its uncoupled position.

It should be noted that in the presently preferred embodiment of the invention, the vane 57 has a rectangular cross section with parallel broad wall surfaces 65, narrow wall surfaces 67 and a length dimension approximately the same as that of the parallel line portions 29 and 31, namely, one-quarter wavelength at the operating frequency of the switch 11. FIGS. 3 and 4 clearly show that the axis of rotation of the vane 57 (axis of the rod 55) is not at its geometric center. This mounting configuration is used so that the vane will be closely spaced to and evenly spaced between the parallel line portions 29 and 31 when in the position of FIG. 3, while being closer to the line portion 29 and having one of its narrow wall surfaces 67 immediately adjacent to but not in contact with the inner surface 69 of the bottom cover plate 15 when rotated to the uncoupled position shown in FIG. 4.

With the vane 57 in the coupled position shown in FIGS. 1 and 3, the transmission line switch 11 functions basically as a conventional TEM-mode, coupled-transmission-line directional coupler described in Chapter 13 of the aforementioned text. That is, a predetermined portion of the power fed to the first port 39 couples to the second port 43 with the remainder coupled to the fourth port 51 and negligible power being coupled to the third port 47. In accordance with conventional practice in this type of coupler, the third port is terminated by a conventional dummy load element 52 matching the port impedance. Unlike a conventional parallel line directional coupler, however, the parallel line portions 29 and 31 are much farther apart and, without the presence of the vane 57 with its broad wall surfaces 65 parallel to the plane of the parallel lines, very little power would be coupled to the second port 43. This is mainly due to the fact that the relatively wide spacing between the parallel lines provides a relatively low value of coupling and the odd and even mode capacitances are approximately equal. Where coupling of power to the second port is desired, the referenced text indicates that the odd-to-even mode capacitance ratio should be relatively high.

In accordance with the present invention, the vane 57, in its coupled position with its narrow walls 67 relatively closely spaced to the parallel line portions 29 and 31, provides the necessary relatively high capacitive coupling between the lines and a relatively high odd-to-even mode capacitance ratio. However, when the vane 57 is moved by rotation of the shaft 55 to its uncoupled position shown in FIG. 4, the vane is virtually at ground potential because of the relatively high capacitive coupling to the inner surface 69 of the bottom plate 15 and acts as an electrostatic shield between the parallel line portions 29 and 31. This greatly reduces the coupling between the lines, while at the same time, because of its asymmetrically located axis of rotation, the vane is moved further from the second parallel line portion 31 to provide a desired capacity to the first line for impedance matching purposes and thus a minimum VSWR.

In the embodiment of the invention illustrated in FIGS. 1, 3 and 4, there is provided 7.7 dB coupling to the second port 43 and a 50 ohm termination impedance, the even mode impedance $Z_{oe}$ is approximately equal to 77.5 ohms and the odd mode impedance $Z_{oo}$ is approximately equal to 32.3 ohms. In the uncoupled configuration the characteristic impedance of the first line is approximately 50 ohms, and in this embodiment, the phase shift at the fourth port 51 relative to the first port 39 is nearly the same for both vane positions.

In a model constructed as shown in the drawing, the following electrical measurements were obtained.

VSWR $< 1.15$ at the first, second and fourth ports in the coupled configuration;

VSWR $< 1.15$ at the first and fourth ports in the uncoupled configuration;

Phase change between the two configurations at the fourth port less than 10° (measured 5°); and Second port coupled power of $-7.8$ dB relative to the input power at the first port when in the coupled state.

The basic design equations used to provide a desired coupling and impedance values are as follows.

$$V_2/V_1 = C \quad (1)$$

$$Z_{oe} = Z_o\sqrt{1+C/1-C} \quad (2)$$

$$Z_o = \sqrt{Z_{oe}Z_{oo}} \quad (3)$$

$$C_{oo}/E = 377/Z_{oo}, \text{ and} \quad (4)$$

$$C_{oe}/E = 377/Z_{oe}, \quad (5)$$

where $V_1$ and $V_2$ are voltages at the first and second ports when all are terminated in $Z_o$, $Z_{oe}$ is the even mode impedance, $C_{oe}$ is the even mode capacitance per unit length, and $Z_{oo}$ and $C_{oo}$ are the corresponding odd mode values. Again, reference should be made to Chapter 13 of the referenced text, as well as to Chapter 5 dealing with TEM-mode transmission lines and illustrating capacitance aspects of coupled rectangular bars centered between parallel plates in FIG. 5.05–11, page 191.

As noted previously, it has been found to be desirable that the vane 57 not come into actual contact with the inner surface 69 of the bottom plate 15 when in its uncoupled position. Such contact tends to introduce undesirable noise and is not needed to provide the desired shielding and impedance matching effects.

From the foregoing it should be evident that there has been described a new and advantageous, simple and yet effective transmission line switch that is light in weight for spacecraft applications and which exhibits a desired amount of directional coupling with a relatively low VSWR.

It should also be understood that the materials and processes described in fabricating the invention are not critical and any material and process exhibiting similar desirable characteristics and structures may be utilized. Further, it should be clear that changes, modifications and other embodiments which are obvious to persons skilled in the art to which the invention pertains are deemed to lie within the spirit, scope and contemplation of the invention.

What is claimed is:

1. A TEM-mode transmission line switch, comprising:

a parallel transmission line coupler including first and second parallel lines; and coupling means including a conductive vane disposed between said parallel lines and rotatable on an axis parallel to said parallel lines for isolating said parallel lines in an uncoupled position and for electromagnetically coupling said parallel lines in a coupled position, said axis being asymmetrical with respect to the cross section of said vane whereby said vane is equally spaced between said parallel lines when in said coupled position, and closer to one of said lines when in said uncoupled position.

2. The transmission line switch according to claim 1, wherein said parallel lines include a mutually parallel line portion of approximately an odd number of quarter wavelengths in length at the operating frequency of said switch.

3. The transmission line switch according to claim 2, wherein said parallel line portion is approximately one-quarter wavelength in length.

4. The transmission line switch according to claim 2, wherein said vane is approximately the length of said parallel line portion.

5. The transmission line switch according to claim 1, wherein said vane is mounted on an axle of insulating material, said axle being rotatably mounted in said switch and having a coupling portion at a portion thereof extending externally of said switch.

6. The transmission line switch according to claim 5, also comprising rotation means coupled to said coupling portion of said axle for rotating said axle and said vane a predetermined amount to affect said coupled and uncoupled positions of said vane.

7. The transmission line switch according to claim 2, also comprising a switch housing including first, second, third and fourth port channels, a central portion, a top and bottom plate, said first parallel line being disposed at its ends in respectively said first and fourth port channels, and said second parallel line being disposed at its ends in respectively said second and third port channels, said mutually parallel line portion being disposed in said central portion of said switch housing.

8. The transmission line switch according to claim 7, wherein said cross section of said vane is rectangular, and wherein a narrow side of said vane is immediately adjacent but not in contact with one of said plates when in said uncoupled position.

* * * * *